US009221570B2

(12) United States Patent
Shinomori et al.

(10) Patent No.: US 9,221,570 B2
(45) Date of Patent: Dec. 29, 2015

(54) PRODUCTION DEVICE AND PRODUCTION METHOD OF LINKED PACKAGED PRODUCTS

(75) Inventors: Youji Shinomori, Kanonji (JP); Seiji Murakami, Kanonji (JP)

(73) Assignee: UNICHARM CORPORATION, Ehime (JP)

( * ) Notice: Subject to any disclaimer, the term of this patent is extended or adjusted under 35 U.S.C. 154(b) by 340 days.

(21) Appl. No.: 13/981,059

(22) PCT Filed: Nov. 15, 2011

(86) PCT No.: PCT/JP2011/076279

§ 371 (c)(1),
(2), (4) Date: Jul. 22, 2013

(87) PCT Pub. No.: WO2012/105104

PCT Pub. Date: Aug. 9, 2012

(65) Prior Publication Data

US 2013/0291486 A1 Nov. 7, 2013

(30) Foreign Application Priority Data

Jan. 31, 2011 (JP) ..... 2011-018152

(51) Int. Cl.
*B65B 9/06* (2012.01)
*B65B 57/02* (2006.01)
(Continued)

(52) U.S. Cl.
CPC ..... *B65B 57/00* (2013.01); *B07C 5/3404* (2013.01); *B07C 5/3422* (2013.01); *B65B 9/067* (2013.01); *B65B 57/02* (2013.01); *B65B 57/10* (2013.01); *B65B 61/06* (2013.01); *B65B 2220/22* (2013.01)

(58) Field of Classification Search
CPC B65B 2210/02; B65B 2220/22; B65B 9/067; B65B 61/06; B65B 61/12; B65B 57/00; B65B 57/02; B65B 57/04; B65B 57/10; B07C 5/3404
USPC ..... 53/53
See application file for complete search history.

(56) References Cited

U.S. PATENT DOCUMENTS 3,942,900 A * 3/1976 Garris ..... 356/239.1
3,965,642 A * 6/1976 Hills et al. ..... 53/450
(Continued)

FOREIGN PATENT DOCUMENTS

CH 700070 A2 * 6/2010 ..... B65B 57/10
DE 3248773 A1 * 7/1984 ..... B65B 57/00
(Continued)

OTHER PUBLICATIONS

International Search Report corresponding to PCT/JP2011/076279, mailed Feb. 21, 2012, 2 pages.

*Primary Examiner* — Stephen F Gerrity
(74) *Attorney, Agent, or Firm* — Hauptman Ham, LLP

(57) ABSTRACT

A production device of linked packaged products comprised of a first set number of packages linked in a line forms and transports a strip of linked packages, judges if the packages in the strip of linked packages are good packages or defective packages, cuts the strip of linked packages each time the first set number of the good packages are successively transported and cuts the strip of linked packages between the good package and the defective package, whereby good products which are comprised of the first set number of the good packages, fractional products which are comprised of a number of the good packages less than the first set number, and defective products which are comprised of at least one of the defective packages are formed, and transports the good products, the fractional products, and the defective products along respectively different transport routes.

8 Claims, 5 Drawing Sheets

(51) Int. Cl.

| | |
|---|---|
| ***B65B 61/06*** | (2006.01) |
| ***B65B 57/00*** | (2006.01) |
| ***B65B 9/067*** | (2012.01) |
| ***B65B 57/10*** | (2006.01) |
| ***B07C 5/34*** | (2006.01) |
| ***B07C 5/342*** | (2006.01) |

(56) References Cited

U.S. PATENT DOCUMENTS

| | | | | |
|---|---|---|---|---|
| 4,472,922 | A * | 9/1984 | Romagnoli | 53/53 |
| 4,703,765 | A * | 11/1987 | Paules et al. | 131/112 |
| 5,359,832 | A * | 11/1994 | Hartman et al. | 53/435 |
| 5,568,715 | A * | 10/1996 | Ebel et al. | 53/54 |
| 5,673,533 | A | 10/1997 | Wang et al. | |
| 7,017,324 | B2 * | 3/2006 | Battisti | 53/550 |
| 2003/0188513 | A1 * | 10/2003 | Battisti | 53/53 |
| 2006/0042190 | A1 * | 3/2006 | Garceau et al. | 53/53 |
| 2006/0271237 | A1 * | 11/2006 | Kim | 700/226 |

FOREIGN PATENT DOCUMENTS

| | | | |
|---|---|---|---|
| EP | 0744341 | A1 | 11/1996 |
| EP | 1449770 | A1 | 8/2004 |
| JP | 2004352287 | A | 12/2004 |
| JP | 200575401 | A | 3/2005 |

* cited by examiner

PRODUCTION DEVICE AND PRODUCTION METHOD OF LINKED PACKAGED PRODUCTS

RELATED APPLICATIONS

The present application is a National Phase of International Application Number PCT/JP2011//076279, filed Nov. 15, 2011, and claims priority from Japanese Application Number 2011-018152, filed Jan. 31, 2011.

TECHNICAL FIELD

The present invention relates to a production device and production method of a linked packaged product.

BACKGROUND ART

Known in the art is a production device of linked packaged products which is comprised of a predetermined set number of packages which are linked in a line, the production device of linked packaged products forming and transporting a strip of linked packages comprised of a plurality of packages linked in a line, cutting the strip of linked packages each time the set number of the packages are successively transported and, when the strip of linked packages includes a defective package, cutting the strip of linked packages so that a different number of the packages from the set number are linked and thereby forming good products not including the defective package and defective products including the defective package, and guiding the good products to a normal route and eliminating the defective products from the normal route (see PLT 1). By doing this, for example, the mass of the good products and the mass of the defective products differ from each other. Therefore, it becomes possible to easily detect the defective products and eliminate them from the normal route.

CITATIONS LIST

Patent Literature

PTL 1: Japanese Patent Publication No. 2004-352287A

SUMMARY OF INVENTION

Technical Problem

However, in the above-mentioned production device, the defective products include the good packages. Therefore, when the defective products are eliminated from the normal route, the good packages will also be eliminated together with the defective packages. That is, it is not possible to effectively use the good packages to produce the good products. As a result, the production efficiency of the good products is liable to fall.

Solution to Problem

According to first aspect of the present invention, there is provided a production device of linked packaged products comprised of a predetermined first set number of packages linked in a line, the production device of linked packaged products comprising a forming unit which forms and transports a strip of linked packages which is comprised of a plurality of packages linked in a line, a judging unit which judges if the packages in the strip of linked packages are respectively good packages or defective packages, a cutting unit which cuts the transported strip of linked packages, which cutting unit cuts the strip of linked packages each time the first set number of the good packages are successively transported and cuts the strip of linked packages between the good package and the defective package, whereby good products which are comprised of the first set number of the good packages, fractional products which are comprised of a number of the good packages less than the first set number, and defective products which are comprised of at least one of the defective packages are formed, and a routing unit which transports the good products, the fractional products, and the defective products along respectively different transport routes.

According to second aspect of the present invention, there is provided a production method of linked packaged products comprised of a predetermined first set number of packages linked in a line, the production method of linked packaged products comprising a forming step of forming and transporting a strip of linked packages which is comprised of a plurality of packages linked in a line, a judging step of judging if the packages in the strip of linked packages are respectively good packages or defective packages, a cutting step of cutting the transported strip of linked packages, which the cutting step cuts the strip of linked packages each time the first set number of the good packages are successively transported and cuts the strip of linked packages between the good package and the defective package, whereby good products which are comprised of the first set number of the good packages, fractional products which are comprised of a number of the good packages less than the first set number, and defective products which are comprised of at least one of the defective packages are formed, and a routing step of transporting the good products, the fractional products, and the defective products along respectively different transport routes.

Solution to Problem

The production efficiency of the linked packaged product can be raised.

DESCRIPTION OF EMBODIMENTS

Figure 1A:
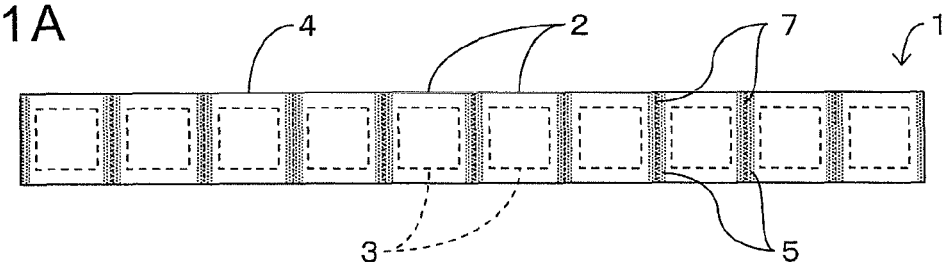
FIG. 1A is a bottom view of a linked packaged product.
Figure 1B:
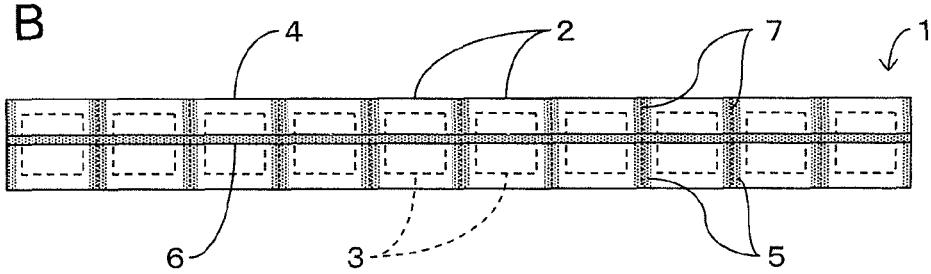
FIG. 1B is a top view of a linked packaged product.

FIGS. 1A, 1B, and 10 respectively show a bottom view, top view and side view of a linked packaged product 1. Referring to FIGS. 1A, 1B, and 10, the linked packaged product 1 is comprised of a predetermined first set number of packages 2. These packages 2 are linked together in a line.

The packages 2 are respectively comprised of contents 3 and packaging materials 4 which package the contents 3 and are sealed by seal parts 5 which extend in the lateral direction at the two ends in the longitudinal direction and seal parts 6 which extend in the longitudinal direction. These packages 2 are linked with each other through weakened lines 7 such as perforated lines provided at the seal parts 5. The linked packaged product 1 is cut along the weakened lines 7 whereby individual packages 2 are obtained.

The packages 2 are for example comprised of packages of absorbent articles. That is, the contents 3 are comprised of absorbent articles such as a sanitary napkins and diapers, while the packaging materials 4 are comprised of sheet materials suitable for packaging the absorbent articles. Further, at the inside surfaces of the packaging materials 4, an adhesive or tackifier is applied. Due to this, the contents 3 are fastened to the packaging materials 4. By doing this, movement of contents 3 inside of the packages 2 can be suppressed.

The first set number can be set to a number of 2 or more. In the embodiment according to the present invention, it is set to 10.

Figure 2:
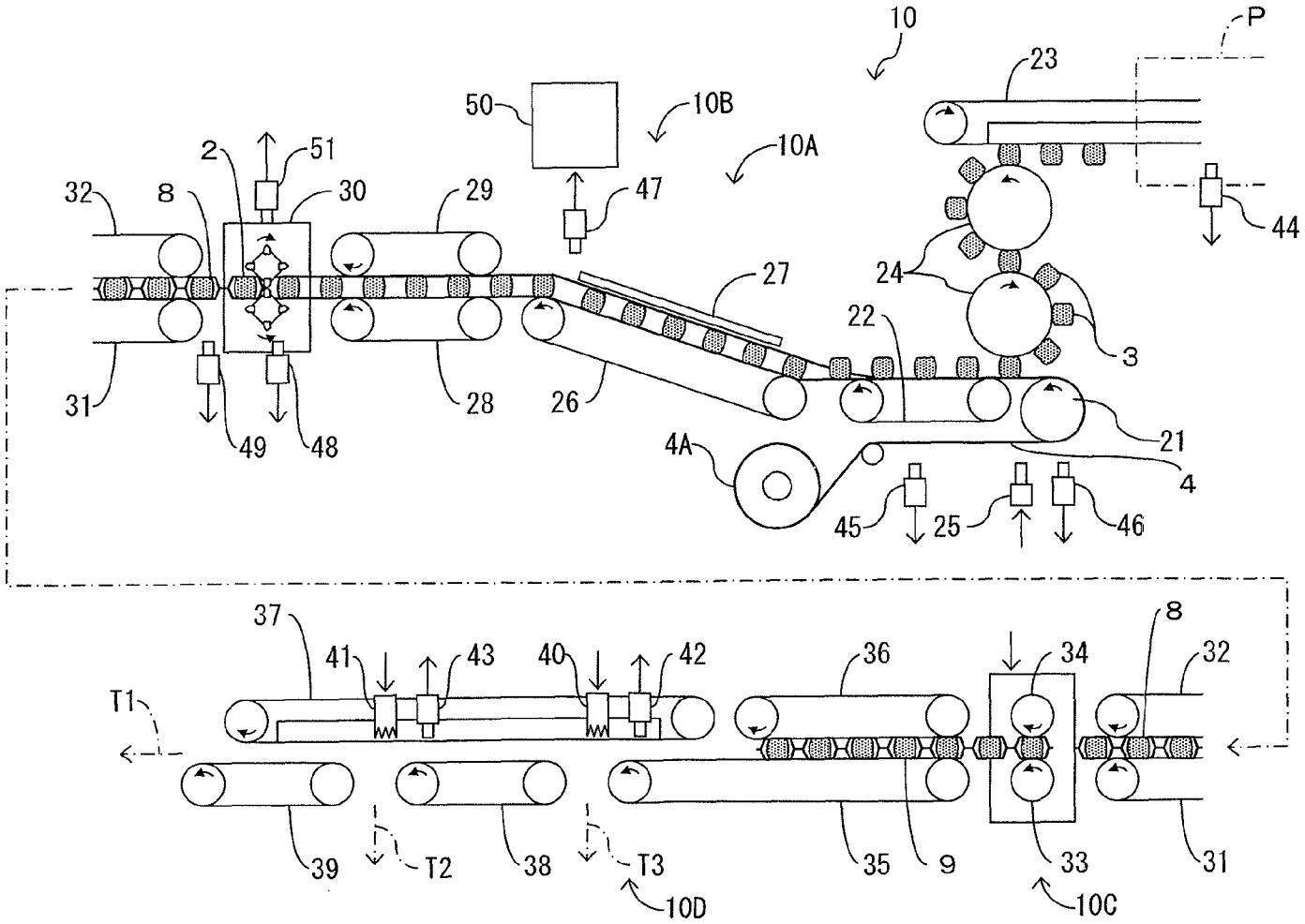
FIG. 2 is a schematic overall view of a linked packaged product production device in an embodiment according to the present invention.

FIG. 2 shows the production device 10 of the linked packaged products 1. Referring to FIG. 2, the linked packaged product production device 10 is provided with a forming unit 10A, judging unit 103, cutting unit 10C, and routing unit 10D.

In the forming unit 10A, a strip of linked packages which is comprised of a plurality of packages 2 linked in a line is formed and transported. Specifically, a roller 21 and belt conveyor 22 are used to unwind the packaging material 4 from a roll 4A which is continuously transported in the form of a web. On the other hand, for example, a negative pressure suction type of belt conveyor 23 and roller 24 are used to transport the contents 3 and successively supply them on the packaging material 4 which is being transported.

Here, the belt conveyor 23 receives the contents 3 from the content production device P which successively produces and discharges the contents 3. That is, the linked packaged product production device 10 is directly connected to the content production device P.

Further, the adhesive applicator 25 is used to intermittently apply an adhesive such as a hot melt adhesive to the packaging material 4. As a result, the contents 3 are fastened to the packaging material 4. Note that, the contents 3 may also be fastened by a tackifier to the packaging material 4 or may not be fastened to the packaging material 4.

The contents 3 and packaging material 4 are next transported by the belt conveyor 26. At this time, a guide member 27 which is arranged facing the belt conveyor 26 is used to bend the packaging material 4 so as to surround the contents 3. In this case, the two edges of the packaging material 4 in the lateral direction are overlaid and an overlaid part which extends in the vertical direction is formed. As a result, the packaging material 4 becomes a tubular shape which holds the contents 3.

Figure 1C:
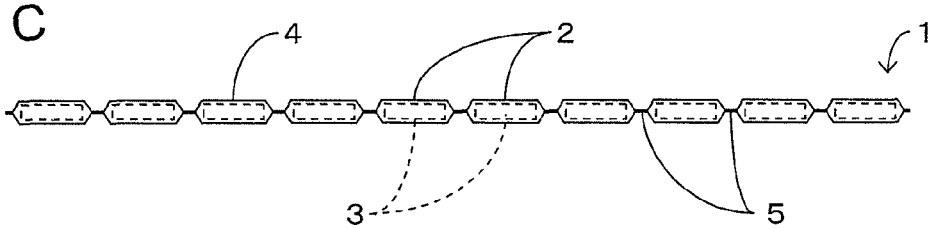
FIG. 1C is a side view of a linked packaged product.

The tubular shape packaging material 4 which holds the contents 3 is next gripped between a pair of belt conveyors 28 and 29 which are arranged facing each other while being further transported in the longitudinal direction and transported to a sealer 30. At the sealer 30, first, the above-mentioned overlaid parts which are formed at the packaging material 4 are sealed whereby the seal parts 6 (FIG. 1B) is formed. Next, between the adjoining contents 3, the packaging material 4 is sealed in the lateral direction whereby seal parts 5 (FIGS. 1A, 1B, and 1C) are formed. Further, the seal parts 5 are formed with weakened lines 7 (FIGS. 1A and 1B). As a result, the packages 2 which are comprised of the contents 3 and the packaging material 4 are formed. At the same time, a strip of linked packages 8 which is comprised of a plurality of packages 2 linked in a line is formed.

The strip of linked packages 8 is gripped between a pair of belt conveyors 31 and 32 which are arranged facing each other while being transported in the longitudinal direction and is transported to the cutting unit 10C.

At the cutting unit 10C, the transported strip of linked packages 8 is cut. That is, the strip of linked packages 8 is gripped between a pair of rollers 33 and 34 which are arranged facing each other while being transported. When the strip of linked packages 8 should not be cut, the rollers 33 and 34 transport the strip of linked packages 8 at substantially the same speed as the belt conveyors 31 and 32. As opposed to this, when the strip of linked packages 8 should be cut, the rollers 33 and 34 transport the strip of linked packages 8 at a higher speed than the belt conveyors 31 and 32. As a result, the downstream side part of the strip of linked packages 8 is gripped by the belt conveyors 31 and 32, so the strip of linked packages 8 is cut along the weakened line 7. In this way, a product 9 which is comprised of at least one of the packages 2 is formed.

The product 9 is next gripped between the pair of rollers 35 and 36 which are arranged facing each other while being transported in the longitudinal direction and is transported to the routing unit 10D.

At the routing unit 10D, the product 9 is, for example, transported by a negative pressure suction type of belt conveyor 37 and belt conveyors 38 and 39 which are arranged facing the belt conveyor 37.

A first transport route T1 passes through between The belt conveyor 37 and the belt conveyor 39, a second transport route T2 passes through between the belt conveyor 38 and the belt conveyor 39, and a third transport route T3 passes through between the belt conveyor 35 and the belt conveyor 38.

Further, deflectors 40 and 41 are provided which deflect the products 9 which are transported by the belt conveyor 37 by for example air jets. When the deflector 40 is operated, a product 9 is separated from the belt conveyor 37 and transported along the third transport route T3. When the operation of the deflector 40 is stopped and the deflector 41 is operated, a product 9 is transported along the second transport route T2. When the operations of the deflectors 40 and 41 are stopped, a product 9 is transported along the first transport route T1. In this way, the products 9 are routed to different transport routes T1, T2, and T3.

Note that, sensors 42 and 43 which detect the positions of the products 9 are attached to the deflectors 40 and 41. The outputs from these sensors 42 and 43 are used as the basis for startup of the deflectors 40 and 41. As a result, the products 9 which should be transported to the second transport route T2 and third transport route T3 can be reliably deflected.

As explained above, at the forming unit 10B, the packages 2 are formed. However, the packages 2 may include not only good packages, but also defective packages. The defective packages include, for example, defective packaging packages or defective content packages. The defective packaging packages include, for example, ones where the packaging material 4 itself is defective, ones where the seal parts 5 and 6 are defective, ones where the contents 3 are not fastened at the right positions with respect to the packaging materials 4, etc. On the other hand, the defective content packages include ones where the contents 3 themselves are defective.

Therefore, the judging unit 10B judges if the packages 2 in the strip of linked packages 8 are good packages or defective packages. This judgment can be performed, for example, by a sensor 44 which is provided at the content production device P and which detects defects of the contents 3, a sensor 45 which detects defects of the packaging material 4, a sensor 46 which detects defects of the adhesive, a sensor 47 which detects defects of the bent packaging material 4, a sensor 48 which detects defects of the seal parts 5 and 6, a sensor 49 which detects defects of positions of the contents 3 with respect to the packaging material 4, etc.

The linked packaged product production device 10 is provided with a controller 50. The controller 50 is, for example, comprised of a computer which is provided with a CPU, memory, input port, and output port. The outputs of the sensors 42, 43, 44, 45, 46, 47, 48, and 49 are input to the controller 50. For example, the sealer 30 has a pulse generator 51 attached to it which generates a pulse each time a package 2 is formed. The pulses which are generated by this pulse generator 51 are also input to the controller 50. Therefore, at the controller 50, it is judged if the packages 2 to be transported to the cutting unit 100, in particular the rollers 33 and 34, are good packages or defective packages. On the other hand, the adhesive applicator 25, rollers 33 and 34 in the cutting unit 100, and deflectors 40 and 41 are also connected to the controller 50 and are controlled based on signals from the controller 50.

Now, in the above-mentioned cutting unit 100, the strip of linked packages 8 is cut each time the first set number of the good packages are successively transported. As a result, the good products which are comprised of the first set number of good packages, that is, linked packaged products 1, are formed.

Further, the strip of linked packages 8 is cut between a good package and a defective package. As a result, fractional products which are comprised of a number of the good packages smaller than the first set number and defective products which are comprised of at least one of the defective packages are formed.

Furthermore, the strip of linked packages 8 is cut each time a predetermined second set number of the defective packages are successively transported. As a result, the above-mentioned defective product is at most comprised of the second set number of defective packages. Note that, the second set number is set to a number of 1 or more. In this embodiment according to the present invention, it is set to 5. Note that, the second set number may be the same as the first set number.

In this way, the above-mentioned products 9 are comprised of the good products, fractional products, and defective products.

Figure 3:
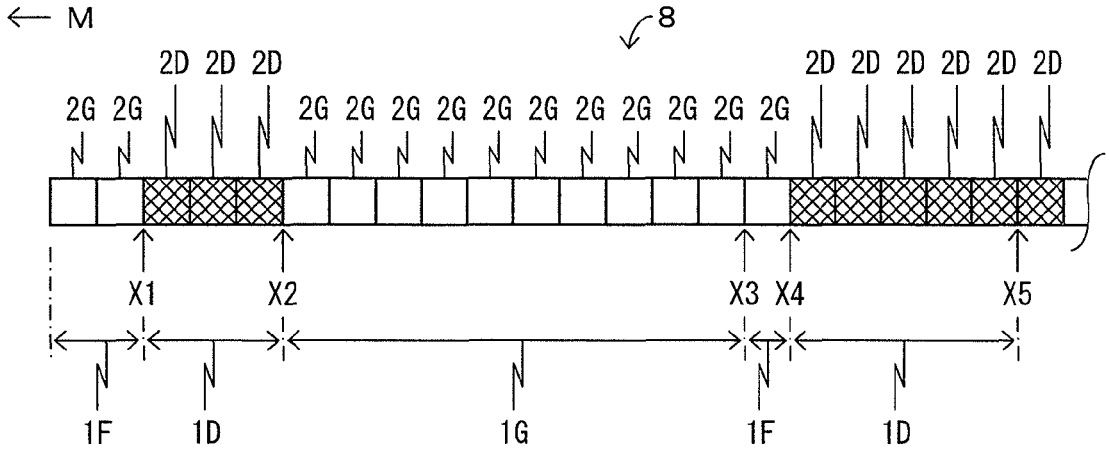
FIG. 3 is a diagram to explain a cutting action in the embodiment of FIG. 2.

Referring to FIG. 3, the cutting action at the cutting unit 100 will be further explained. Note that, in FIG. 3, M shows the direction of transport of the strip of linked packages 8.

As shown in FIG. 3 by X1, when the packages 2 which are transported to the cutting unit 100 switch from good packages 2G to defective packages 2D, the strip of linked packages 8 is cut. As a result, a fractional product 1F is formed. Next, as shown by X2, when the packages 2 which are transported switch from defective package 2D to good packages 2G, the strip of linked packages 8 is cut. As a result, a defective product 1D is formed. Next, as shown by X3, when good packages 2G are successively transported in exactly the first set number, the strip of linked packages 8 is cut whereby a good product 1G is formed.

Next, as shown by X4, when the packages 2 which are transported switch from good packages 2G to defective packages 2D, the strip of linked packages 8 is cut and a fractional product 1F is formed. Next, as shown by X5, when defective packages 2D are transported successively in exactly the second set number, the strip of linked packages 8 is cut whereby a defective product 1D is formed.

On top of this, the good products 1G are transported along the first transport route T1, the fractional products 1F are transported along the second transport route T2, and the defective products 1D are transported along the third transport route T3. That is, the good products 1G, fractional products 1F, and defective products 1D are transported along respectively different transport routes T1, T2, and T3.

Note that, whether the products 9 are the good products 1G, fractional products 1F, or defective products 1D is determined by the controller 50 based on whether the packages 2 to be transported to the cutting unit 10C are the good packages 2G or defective packages 2D.

By doing this, the defective products 1D do not include good packages 2G. Therefore, the production efficiency of the good products 1G, that is, the linked packaged products 1, can be raised. Note that, the defective products 1D are discarded.

Further, the fractional products 1F do not include the defective package 2D. Therefore, the fractional products 1F are linked with each other so that the first set number of the good packages 2G are linked, whereby the good products 1G can be formed. Therefore, the production efficiency of the linked packaged products 1 can be further raised.

Furthermore, the defective products 1D are at most comprised of a second set number of defective packages 2D. That is, the defective products 1D are prevented from becoming excessively long. Therefore, the defective products 1D can be transported well along the third transport route T3.

Note that, in an embodiment according to the present invention, even if the content 3 itself is defective, the defective content 3 is not discharged from the content production device P. That is, the defective content 3 is supplied to the linked packaged product production device 10 and packaged. Therefore, the forming unit 10A successively packages the contents 3 which are successively supplied from the content production device P by the continuous packaging material 4 to form the strip of linked packages 8. By doing this, all of the packages 2 contain the contents 3.

Figure 4:
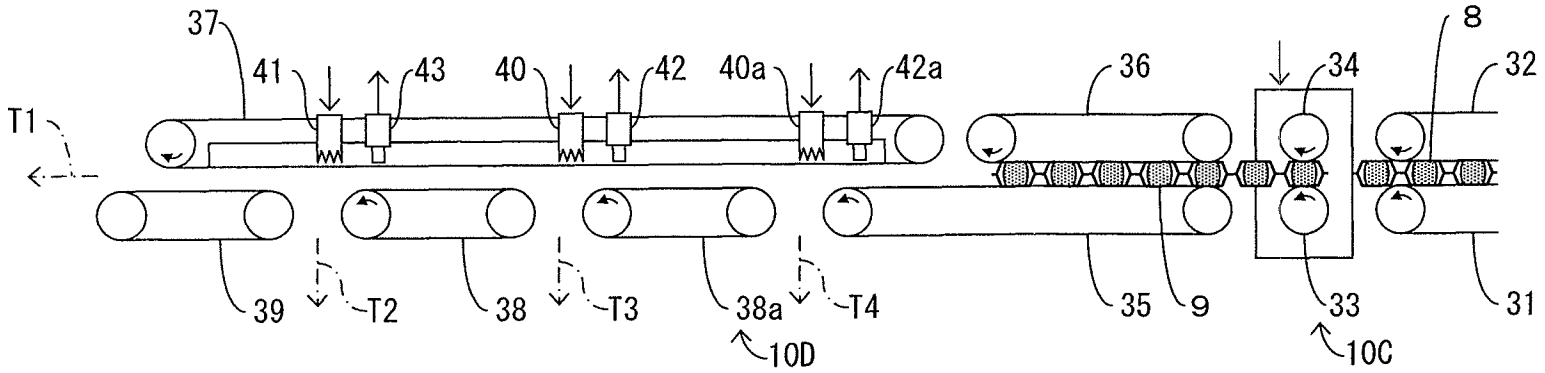
FIG. 4 is a schematic partial view of a linked packaged product production device in another embodiment of the present invention.

FIG. 4 shows another embodiment according to the present invention. Referring to FIG. 4, at the routing unit 10D, the products 9 are transported by the belt conveyor 37 and the belt conveyors 38*a*, 38, and 39 which are arranged facing the belt conveyor 37.

A first transport route T1 passes through between the belt conveyor 37 and the belt conveyor 39, a second transport route T2 passes through between the belt conveyor 38 and the belt conveyor 39, a third transport route T3 passes through between the belt conveyor 38*a* and the belt conveyor 38, and a fourth transport route T4 passes through between the belt conveyor 35 and the belt conveyor 38*a*.

Further, deflectors 40*a*, 40, and 41 are provided which deflect the products 9 which are transported by the belt conveyor 37 by for example air jets. When the deflector 40*a* is operated, the products 9 are separated from the belt conveyor 37 and are transported along the fourth transport route T4. When the operation of the deflector 40*a* is stopped while the deflector 40 is operated, the products 9 are transported along the third transport route T3. When the operations of the deflectors 40*a* and 40 are stopped while the deflector 41 is operated, the products 9 are transported by the second transport route T2. When the operations of the deflectors 40*a*, 40, and 41 are stopped, the products 9 are transported along the first transport route T1.

Furthermore, sensors 42*a*, 42, and 43 which detect the positions of the products 9 are attached to the deflectors 40*a*, 40, and 41.

In the embodiment which is shown in FIG. 4, the judging unit 10B judges if the packages 2 in the strip of linked packages 8 are the good packages, defective packaging packages, or defective content packages.

On top of this, at the cutting unit 10C, the strip of linked packages 8 is cut each time the first set number of the good packages are successively transported. As a result, the good products which are comprised of the first set number of the good packages, that is, the linked packaged products 1, are formed.

Further, the strip of linked packages 8 is cut between the good package and defective packaging package, between the good package and defective content package, and between the defective packaging package and defective content package. As a result, the fractional product, a defective packaging product which is comprised at least one of the defective packaging packages, and a defective content product which is comprised of at least one of the defective content packages are formed.

Furthermore, the strip of linked packages 8 is cut each time a second set number of the defective packaging packages or defective content packages are successively transported. As a result, the defective packaging products and defective content products are respectively comprised of at most the second set number of the defective packaging packages and defective content packages.

Therefore, in this case, the products 9 are comprised of the good products, fractional products, defective packaging packages, and defective content products.

Figure 5:
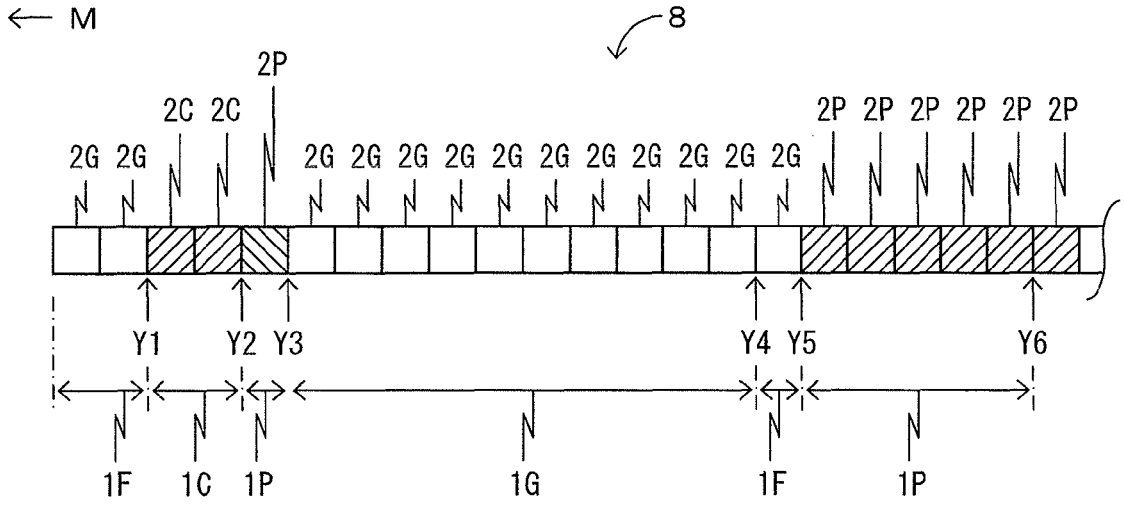
FIG. 5 is a diagram to explain a cutting action in the embodiment of FIG. 4.

Referring to FIG. 5, the cutting action at the cutting unit 100 will be further explained. Note that, in FIG. 5, M shows the direction of transport of the strip of linked packages 8.

In FIG. 5, as shown in Y1, when the packages 2 which are transported to the cutting unit 100 switch from good packages 2G to for example defective content packages 2C, the strip of linked packages 8 is cut. As a result, a fractional product 1F is formed. Next, as shown by Y2, when the packages 2 which are transported switch from defective content packages 2C to defective packaging packages 2P, the strip of linked packages 8 is cut. As a result, a defective content product 10 is formed. Next, as shown by Y3, when the packages 2 which are transported switch from defective packaging packages 2P to good packages 2G, the strip of linked packages 8 is cut. As a result, a defective packaging product 1P is formed. Next, as shown by Y4, when good packages 2G are successively transported in exactly the first set number, the strip of linked packages 8 is cut and a good product 1G is formed.

Next, as shown by Y5, when the packages 2 which are transported switch from good packages 2G to for example defective packaging packages 2P, the strip of linked packages 8 is cut and a fractional product 1F is formed. Next, as shown by Y6, when defective packaging packages 2P are transported successively in exactly the second set number, the strip of linked packages 8 is cut and a defective packaging product 1P is formed.

On top of this, the good products 1G are transported along the first transport route T1, the fractional products 1F are transported along the second transport route T2, the defective packaging products 1P are transported along the third transport route T3, and the defective content products 10 are transported along the fourth transport route T4. That is, the good products 1G, fractional products 1F, defective packaging products 1P, and defective content products 10 are transported along respectively different transport routes T1, T2, T3, and T4.

By doing this, the defective packaging products 1P and defective content products 10 can be separately routed. The defective content products 1C are discarded. As opposed to this, good contents 3 are taken out from the packages 2 forming the defective packaging products 1P. Next, these contents 3 are normally packaged by the packaging material 4 whereby the good packages 2G are formed.

The present application asserts the benefit of Japanese Patent Application No. 2011-018152, of which the disclosure as a whole is cited by reference here.

REFERENCE SIGNS LIST

1 linked packaged product
2 package
3 content
4 packaging material
10 linked packaged product production device
10A forming unit
10B judging unit
10C cutting unit
10D routing unit

The invention claimed is:

1. A production device of linked packaged products comprised of a predetermined first set number of packages linked in a line, the production device of linked packaged products comprising a forming unit which forms and transports a strip of linked packages which is comprised of a plurality of packages linked in a line, a judging unit which judges if the packages in the strip of linked packages are respectively good packages or defective packages, a cutting unit which cuts the transported strip of linked packages, which cutting unit cuts the strip of linked packages each time the first set number of the good packages are successively transported and cuts the strip of linked packages between the good package and the defective package, whereby good products which are comprised of the first set number of the good packages, fractional products which are comprised of a number of the good packages less than the first set number, and defective products which are comprised of at least one of the defective packages are formed, and a routing unit which transports the good products, the fractional products, and the defective products along respectively different transport routes.

2. The production device of linked packaged products as set forth in claim 1, wherein the packages are comprised of contents and a packaging material which packages the contents and wherein the contents are fastened to the packaging material by an adhesive or tackifier.

3. The production device of linked packaged products as set forth in claim 1, wherein the defective packages include defective packaging packages or defective content packages.

4. The production device of linked packaged products as set forth in claim 3, wherein the judging unit judges if the packages in the strip of linked packages are respectively the good packages, the defective packaging packages, or the defective content packages, the cutting unit cuts the strip of linked packages each time the first set number of the good packages are successively transported and cuts the strip of linked packages between the good package and the defective packaging package, between the good package and the defective content package, and between the defective packaging package and the defective content package to thereby form the good product, the fractional product, a defective packaging product which is comprised of at least one of the defective packaging packages, and a defective content product which is comprised of at least one of the defective content packages, and, the routing unit transports the good products, the fractional products, the defective packaging products, and the defective content products along respectively different transport routes.

5. The production device of linked packaged products as set forth in claim 1, wherein the cutting unit cuts the strip of linked packages each time a predetermined second set number of the defective packages are successively transported.

6. The production device of linked packaged products as set forth in claim 1, wherein the forming unit successively packages contents which are successively supplied from a content production device by a continuous packaging material to form the strip of linked packages.

7. The production device of linked packaged products as set forth in claim 1, wherein the packages are comprised of packages of absorbent articles.

8. A production method of linked packaged products comprised of a predetermined first set number of packages linked in a line, the production method of linked packaged products comprising a forming step of forming and transporting a strip of linked packages which is comprised of a plurality of packages linked in a line, a judging step of judging if the packages in the strip of linked packages are respectively good packages or defective packages, a cutting step of cutting the transported strip of linked packages, which cutting step cuts the strip of linked packages each time the first set number of the good packages are successively transported and cuts the strip of linked packages between the good package and the defective package, whereby good products which are comprised of the first set number of the good packages, fractional products which are comprised of a number of the good packages less than the first set number, and defective products which are comprised of at least one of the defective packages are formed, and a routing step of transporting the good products, the fractional products, and the defective products along respectively different transport routes.

* * * * *